US006300586B1

(12) United States Patent
Doughty et al.

(10) Patent No.: US 6,300,586 B1
(45) **Date of Patent: *Oct. 9, 2001**

(54) ARC RUNNER RETAINING FEATURE

(75) Inventors: Dennis J. Doughty, Plainville; Dave S. Christensen, Harwinton, both of CT (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/454,205

(22) Filed: Dec. 9, 1999

(51) Int. Cl.[7] ..... H01H 33/20; H01H 9/30; H01H 33/04

(52) U.S. Cl. ..... 218/148; 218/40

(58) Field of Search ..... 218/22–40, 148, 218/149–151, 146, 147

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia | 335/9 |
| 4,220,934 | 9/1980 | Wafer et al. | 335/16 |
| 4,229,630 * | 10/1980 | Wafer et al. | 218/149 |
| 4,237,355 * | 12/1980 | Fechant et al. | 218/40 |
| 4,237,365 * | 12/1980 | Fechant et al. | 218/40 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |

(List continued on next page.)

FOREIGN PATENT DOCUMENTS

| | | |
|---|---|---|
| 819 008 A | 12/1974 | (BE) . |
| 897 691 A | 3/1984 | (BE) . |
| 12 27 978 | 11/1966 | (DE) . |

(List continued on next page.)

*Primary Examiner*—J. R. Scott
(74) *Attorney, Agent, or Firm*—Cantor Colburn LLP; Carl B. Horton

(57) ABSTRACT

An arc runner is fixedly retained on a load (or line) strap without hardware and without employing a mechanical operation. Either the arc runner or the strap has features, such as legs or holes, which engage notches or pins on either the strap or the arc runner and cause the arc runner to be retained on the strap.

9 Claims, 6 Drawing Sheets

U.S. PATENT DOCUMENTS

| | | | | |
|---|---|---|---|---|
| 4,467,297 | | 8/1984 | Boichot-Castagne et al. | 335/8 |
| 4,468,645 | | 8/1984 | Gerbert-Gaillard et al. | 335/42 |
| 4,470,027 | | 9/1984 | Link et al. | 335/16 |
| 4,479,143 | | 10/1984 | Watanabe et al. | 358/44 |
| 4,488,133 | | 12/1984 | McClellan et al. | 335/16 |
| 4,492,941 | | 1/1985 | Nagel | 335/13 |
| 4,541,032 | | 9/1985 | Schwab | 361/331 |
| 4,546,224 | | 10/1985 | Mostosi | 200/153 G |
| 4,550,360 | | 10/1985 | Dougherty | 361/93 |
| 4,562,419 | | 12/1985 | Preuss et al. | 335/195 |
| 4,589,052 | | 5/1986 | Dougherty | 361/94 |
| 4,595,812 | | 6/1986 | Tamaru et al. | 200/307 |
| 4,611,187 | | 9/1986 | Banfi | 335/16 |
| 4,612,430 | | 9/1986 | Sloan et al. | 200/327 |
| 4,616,198 | | 10/1986 | Pardini | 335/16 |
| 4,622,444 | | 11/1986 | Kandatsu et al. | 200/303 |
| 4,631,625 | | 12/1986 | Alexander et al. | 361/94 |
| 4,642,431 | | 2/1987 | Tedesco et al. | 200/153 G |
| 4,644,438 | | 2/1987 | Puccinelli et al. | 361/75 |
| 4,649,247 | | 3/1987 | Preuss et al. | 200/244 |
| 4,654,490 | * | 3/1987 | Leone et al. | 218/33 |
| 4,654,491 | * | 3/1987 | Maier et al. | 218/33 |
| 4,658,322 | | 4/1987 | Rivera | 361/37 |
| 4,672,501 | | 6/1987 | Bilac et al. | 361/96 |
| 4,675,481 | | 6/1987 | Markowski et al. | 200/144 R |
| 4,682,264 | | 7/1987 | Demeyer | 361/96 |
| 4,689,588 | * | 8/1987 | Murata et al. | 335/201 |
| 4,689,712 | | 8/1987 | Demeyer . | |
| 4,694,373 | | 9/1987 | Demeyer | 361/96 |
| 4,710,845 | | 12/1987 | Demeyer | 361/96 |
| 4,717,985 | | 1/1988 | Demeyer | 361/96 |
| 4,733,211 | | 3/1988 | Castonguay et al. | 335/192 |
| 4,733,321 | | 3/1988 | Lindeperg | 361/96 |
| 4,764,650 | | 8/1988 | Bur et al. | 200/153 G |
| 4,768,007 | | 8/1988 | Mertz et al. | 335/202 |
| 4,771,140 | * | 9/1988 | Fujii et al. | 218/148 |
| 4,780,786 | | 10/1988 | Weynachter et al. | 361/87 |
| 4,831,221 | | 5/1989 | Yu et al. | 200/553 |
| 4,870,531 | | 9/1989 | Danek | 361/93 |
| 4,883,931 | | 11/1989 | Batteaux et al. | 200/148 R |
| 4,884,047 | | 11/1989 | Baginski et al. | 335/10 |
| 4,884,164 | | 11/1989 | Dziura et al. | 361/97 |
| 4,900,882 | | 2/1990 | Bernard et al. | 200/147 R |
| 4,910,485 | | 3/1990 | Bolongeat-Mobleu et al. | 335/195 |
| 4,914,541 | | 4/1990 | Tripodi et al. | 361/94 |
| 4,916,420 | | 4/1990 | Bartolo et al. | 335/172 |
| 4,916,421 | | 4/1990 | Pardini et al. | 335/185 |
| 4,926,282 | | 5/1990 | McGhie | 361/102 |
| 4,935,590 | | 6/1990 | Malkin et al. | 200/148 A |
| 4,937,706 | | 6/1990 | Schueller et al. | 361/396 |
| 4,939,492 | | 7/1990 | Raso et al. | 335/42 |
| 4,943,691 | | 7/1990 | Mertz et al. | 200/151 |
| 4,943,888 | | 7/1990 | Jacob et al. | 361/96 |
| 4,950,855 | | 8/1990 | Bolonegeat-Mobleu et al. | 200/148 A |
| 4,951,019 | | 8/1990 | Gula | 335/166 |
| 4,952,897 | | 8/1990 | Barnel et al. | 335/147 |
| 4,958,135 | | 9/1990 | Baginski et al. | 335/8 |
| 4,965,543 | | 10/1990 | Batteux | 335/174 |
| 4,983,788 | | 1/1991 | Pardini | 200/16 R |
| 5,001,313 | | 3/1991 | Leclerq et al. | 200/148 B |
| 5,004,878 | | 4/1991 | Seymour et al. | 200/144 R |
| 5,029,301 | | 7/1991 | Nebon et al. | 335/16 |
| 5,030,804 | | 7/1991 | Abri | 200/323 |
| 5,057,655 | | 10/1991 | Kersusan et al. | 200/148 B |
| 5,075,520 | * | 12/1991 | Mueller et al. | 218/36 |
| 5,077,627 | | 12/1991 | Fraisse | 361/93 |
| 5,083,081 | | 1/1992 | Barrault et al. | 324/126 |
| 5,095,183 | | 3/1992 | Raphard et al. | 200/148 A |
| 5,103,198 | | 4/1992 | Morel et al. | 335/6 |
| 5,115,371 | | 5/1992 | Tripodi | 361/106 |
| 5,120,921 | | 6/1992 | DiMarco et al. | 200/401 |
| 5,132,865 | | 7/1992 | Mertz et al. | 361/6 |
| 5,138,121 | | 8/1992 | Streich et al. | 200/293 |
| 5,140,115 | | 8/1992 | Morris | 200/308 |
| 5,153,802 | | 10/1992 | Mertz et al. | 361/18 |
| 5,155,315 | | 10/1992 | Malkin et al. | 200/148 R |
| 5,166,483 | | 11/1992 | Kersusan et al. | 200/144 A |
| 5,172,087 | | 12/1992 | Castonguay et al. | 335/160 |
| 5,178,504 | | 1/1993 | Falchi | 411/553 |
| 5,184,717 | | 2/1993 | Chou et al. | 200/401 |
| 5,187,339 | | 2/1993 | Lissandrin | 200/148 F |
| 5,198,956 | | 3/1993 | Dvorak | 361/106 |
| 5,200,724 | | 4/1993 | Gula et al. | 335/166 |
| 5,210,385 | | 5/1993 | Morel et al. | 200/146 R |
| 5,239,150 | | 8/1993 | Bolongeat-Mobleu et al. | 200/148 R |
| 5,260,533 | | 11/1993 | Livesey et al. | 200/401 |
| 5,262,744 | | 11/1993 | Arnold et al. | 335/8 |
| 5,280,144 | | 1/1994 | Bolongeat-Mobleu et al. | 200/148 R |
| 5,281,776 | | 1/1994 | Morel et al. | 200/144 |
| 5,296,660 | | 3/1994 | Morel et al. | 200/146 R |
| 5,296,664 | | 3/1994 | Crookston et al. | 200/401 |
| 5,298,874 | | 3/1994 | Morel et al. | 335/8 |
| 5,300,907 | | 4/1994 | Nereau et al. | 335/172 |
| 5,310,971 | | 5/1994 | Vial et al. | 200/244 |
| 5,313,180 | | 5/1994 | Vial et al. | 335/16 |
| 5,317,471 | | 5/1994 | Izoard et al. | 361/105 |
| 5,331,500 | | 7/1994 | Corcoles et al. | 361/93 |
| 5,334,808 | | 8/1994 | Bur et al. | 200/50 |
| 5,341,191 | | 8/1994 | Crookston et al. | 335/16 |
| 5,347,096 | | 9/1994 | Bolongeat-Mobleu et al. | 200/148 B |
| 5,347,097 | | 9/1994 | Bolongeat-Mobleu et al. | 200/148 B |
| 5,350,892 | | 9/1994 | Rozier | 200/144 B |
| 5,357,066 | | 10/1994 | Morel et al. | 200/17 R |
| 5,357,068 | | 10/1994 | Rozier | 200/148 R |
| 5,357,394 | | 10/1994 | Piney | 361/72 |
| 5,361,052 | | 11/1994 | Ferullo et al. | 335/172 |
| 5,373,130 | | 12/1994 | Barrault et al. | 200/147 R |
| 5,379,013 | | 1/1995 | Coudert | 335/17 |
| 5,424,701 | | 6/1995 | Castonguary et al. | 335/172 |
| 5,438,176 | | 8/1995 | Bonnardel et al. | 200/400 |
| 5,440,088 | | 8/1995 | Coudert et al. | 200/303 |
| 5,449,871 | | 9/1995 | Batteux et al. | 200/401 |
| 5,450,048 | | 9/1995 | Leger et al. | 335/132 |
| 5,451,729 | | 9/1995 | Onderka et al. | 200/18 |
| 5,457,295 | | 10/1995 | Tanibe et al. | 200/293 |
| 5,467,069 | | 11/1995 | Payet-Burin et al. | 335/42 |
| 5,469,121 | | 11/1995 | Payet-Burin | 335/16 |
| 5,475,558 | | 12/1995 | Barjonnet et al. | 361/64 |
| 5,477,016 | | 12/1995 | Baginski et al. | 200/43.11 |
| 5,479,143 | | 12/1995 | Payet-Burin | 335/202 |
| 5,483,212 | | 1/1996 | Lankuttis et al. | 335/132 |
| 5,485,343 | | 1/1996 | Santos et al. | 361/115 |
| 5,493,083 | | 2/1996 | Olivier | 200/17 R |
| 5,504,284 | | 4/1996 | Lazareth et al. | 200/50 R |
| 5,504,290 | | 4/1996 | Baginski et al. | 200/401 |
| 5,510,761 | | 4/1996 | Boder et al. | 335/172 |
| 5,512,720 | | 4/1996 | Coudert et al. | 200/400 |
| 5,515,018 | | 5/1996 | DiMarco et al. | 335/16 |
| 5,519,561 | | 5/1996 | Mrenna et al. | 361/105 |
| 5,534,674 | | 7/1996 | Steffens | 218/154 |
| 5,534,832 | | 7/1996 | Duchemin et al. | 335/16 |
| 5,534,835 | | 7/1996 | McColloch et al. | 335/172 |
| 5,534,840 | | 7/1996 | Cuingnet | 337/1 |
| 5,539,168 | | 7/1996 | Linzenich | 200/303 |
| 5,543,595 | | 8/1996 | Mader et al. | 200/401 |
| 5,548,258 | * | 8/1996 | Koboyama et al. | 335/16 |
| 5,552,755 | | 9/1996 | Fello et al. | 335/18 |
| 5,581,219 | | 12/1996 | Nozawa et al. | 335/132 |
| 5,604,656 | | 2/1997 | Derrick et al. | 361/187 |
| 5,608,367 | | 3/1997 | Zoller et al. | 335/132 |

| | | | | |
|---|---|---|---|---|
| 5,784,233 | | 7/1998 | Bastard et al. | 361/36 |
| 5,818,003 | * | 10/1998 | Moldovan et al. | 218/26 |
| 5,877,467 | * | 3/1999 | Arnold et all | 218/148 |

FOREIGN PATENT DOCUMENTS

| | | | |
|---|---|---|---|
| 30 47 360 | | 6/1982 | (DE) . |
| 38 02 184 | | 8/1989 | (DE) . |
| 38 43 277 | | 6/1990 | (DE) . |
| 44 19 240 | | 1/1995 | (DE) . |
| 0 061 092 | | 9/1982 | (EP) . |
| 0 064 906 | | 11/1982 | (EP) . |
| 0 066 486 | | 12/1982 | (EP) . |
| 0 076 719 | | 4/1983 | (EP) . |
| 0 117 094 | | 8/1984 | (EP) . |
| 0 140 761 | | 5/1985 | (EP) . |
| 0 174 904 | | 3/1986 | (EP) . |
| 0 196 241 | | 10/1986 | (EP) . |
| 0 224 396 | | 6/1987 | (EP) . |
| 0 235 479 | | 9/1987 | (EP) . |
| 0 239 460 | | 9/1987 | (EP) . |
| 0 258 090 | | 3/1988 | (EP) . |
| 0 264 313 | | 4/1988 | (EP) . |
| 0 264 314 | | 4/1988 | (EP) . |
| 0 283 189 | | 9/1988 | (EP) . |
| 0 283 358 | | 9/1988 | (EP) . |
| 0 291 374 | | 11/1988 | (EP) . |
| 0 295 155 | | 12/1988 | (EP) . |
| 0 295 158 | | 12/1988 | (EP) . |
| 0 309 923 | | 4/1989 | (EP) . |
| 0 313 106 | | 4/1989 | (EP) . |
| 0 313 422 | | 4/1989 | (EP) . |
| 0 314 540 | | 5/1989 | (EP) . |
| 0 331 586 | | 9/1989 | (EP) . |
| 0 337 900 | | 10/1989 | (EP) . |
| 0 342 133 | | 11/1989 | (EP) . |
| 0 367 690 | | 5/1990 | (EP) . |
| 0 371 887 | | 6/1990 | (EP) . |
| 0 375 568 | | 6/1990 | (EP) . |
| 0 394 144 | | 10/1990 | (EP) . |
| 0 394 922 | | 10/1990 | (EP) . |
| 0 399 282 | | 11/1990 | (EP) . |
| 0 407 310 | | 1/1991 | (EP) . |
| 0 452 230 | | 10/1991 | (EP) . |
| 0 555 158 | | 8/1993 | (EP) . |
| 0 560 697 | | 9/1993 | (EP) . |
| 0 567 416 | | 10/1993 | (EP) . |
| 0 595 730 | | 5/1994 | (EP) . |
| 0 619 591 | | 10/1994 | (EP) . |
| 0 665 569 | | 8/1995 | (EP) . |
| 0 700 140 | | 3/1996 | (EP) . |
| 0 889 498 | | 1/1999 | (EP) . |
| 2 410 353 | | 6/1979 | (FR) . |
| 2 512 582 | | 3/1983 | (FR) . |
| 2 553 943 | | 4/1985 | (FR) . |
| 2 592 998 | | 7/1987 | (FR) . |
| 2 682 531 | | 4/1993 | (FR) . |
| 2 697 670 | | 5/1994 | (FR) . |
| 2 699 324 | | 6/1994 | (FR) . |
| 2 714 771 | | 7/1995 | (FR) . |
| 2 233 155 | | 1/1991 | (GB) . |
| 1 227 978 | | 4/1986 | (SU) . |
| 92/00598 | | 1/1992 | (WO) . |
| WO 92/00598 | * | 1/1992 | (WO) . |
| WO-92/00598-A | * | 1/1992 | (WO) . |
| 92/05649 | | 4/1992 | (WO) . |
| 94/00901 | | 1/1994 | (WO) . |

* cited by examiner

ARC RUNNER RETAINING FEATURE

BACKGROUND OF THE INVENTION

The present invention relates to securing an arc runner to a load or line strap, and more particularly, to securing an arc runner to a load or line strap without using hardware or a mechanical operation.

Circuit breakers are one of a variety of overcurrent protective devices used for circuit protection and isolation. The basic function of a circuit breaker is to provide electrical system protection whenever an electrical abnormality occurs in any part of the system. In a circuit breaker, current enters the system from a power line. The current passes through a strap to a stationary contact fixed on the strap and then to a movable contact. The movable contact is fixedly attached to an arm, and the arm is mounted to a rotor. As long as the stationary and movable contacts are in physical contact, current passes from the stationary contact to the movable contact and out of the circuit breaker to down line electrical devices.

In the event of an overcurrent condition (e.g., a short circuit), extremely high electromagnetic forces are generated. These electromagnetic forces repel the movable contact away from the stationary contact. Because the movable contact is fixedly attached to a rotating arm, the arm pivots and physically separates the stationary and movable contacts thus blowing open (tripping) the circuit. Upon separation of the contacts and blowing,open the circuit, an arcing condition occurs. It is desirable to suppress the resultant arc in order to avoid a hazardous condition. The typical method of suppressing the arc is to direct it into an arc chute, which is generally a series of metal plates that dissipate the energy of the arc. This arc chute is situated proximate to the stationary contact point of the circuit.

An arc runner is used to direct the arc to the arc chute. The arc runner substantially covers the exposed area of the stationary contact disposed on the strap. Blowing a circuit open thus resulting in an arc causes tremendous stress to the parts of the system. Since the arc runner provides a pathway for the arc to follow to the arc chute, it is subject to intensely high temperatures. The construction of an arc runner, and especially its manner of seducement to the strap, is critical to reliable dissipation of an arc.

Conventional methods of securing an arc runner to a load or line strap increase the costs of manufacturing a circuit breaker because of the hardware involved. The arc runner is typically screwed onto the strap, as described in U.S. Pat. No. 5,877,467 entitled "Circuit Breaker Current Limiting Arc Runner". Similarly, U.S. Pat. No. 5,075,520 entitled "Contact Member for Electrical Switching Devices" describes an arc runner having one end inserted into a groove in a block and then having the arc runner secured to the block by a screw. The use of a screw in the fastening operation adds the cost of an extra piece of hardware to the manufacturing process.

Bolts are also used to secure an arc runner to a strap. For example, U.S. Pat. No. 4,229,630 entitled "Circuit Breaker Utilizing Improved Arc Chambers" describes using a pair of bolts that extend through openings in an arc runner to secure the arc runner to a stationary contact. Another method of securing an arc runner to a strap includes the use of rivets, as discussed in U.S. Pat. No. 4,771,140 entitled "Circuit Interrupter", wherein a single rivet pierces the body of an arc runner and a stationary conductor to firmly connect the arc runner to the stationary conductor. Bolts and rivets add the cost of an extra piece of hardware to the manufacturing process in the same way that screws do.

Welding, as discussed in U.S. Pat. No. 5,818,003 entitled "Electric Switch with Arc Chute, Radially Converging Arc Splitter Plates, and Movable and Stationary Arc Runners", provides a further option for securing an arc runner to a strap, wherein the strap is directly welded to a D-shaped arc runner. Although welding does not introduce an additional discrete component into the manufacturing process, it does contribute to the expenses associated with the finished product.

In addition to the costs of the hardware used to fasten the arc runner to the strap, tools are required. Automated assembly systems and automated welders are usually expensive to install and run. Furthermore, the maintenance for these systems is costly, and the use of such systems often poses reliability concerns. Hand-held tools such as wrenches and screwdrivers, on the other hand, are far less expensive. The use of small hand-held tools may, however, increase the time required for assembly of an arc runner to a load strap because machine assembly is usually faster than hand assembly is. An increase in the time required for assembly using hand-held tools is becoming cost prohibitive. Furthermore, hand-held tools, because of their size, frequently tend to be misplaced and need to be replaced on a regular basis. Constant replacement of even the most inexpensive tools can be a limiting factor.

SUMMARY OF THE INVENTION

In an exemplary embodiment of the invention, an arc runner is fixedly retained on a load or line strap proximate an electrical contact in a circuit breaker. The arc runner is comprised of a main body portion capable of directing an arc to an arc dissipating chute and a retaining portion that allows the arc runner to be secured to the strap. The main body portion generally conforms to the shape of the strap on which the arc runner is positioned. The retaining portion is configured and dimensioned to utilize the structure of the strap to hold the main body portion onto the strap without hardware and without employing mechanical operations thus eliminating additional attachment hardware and/or mechanical attachment operations of the prior art.

DETAILED DESCRIPTION

Figure 1:
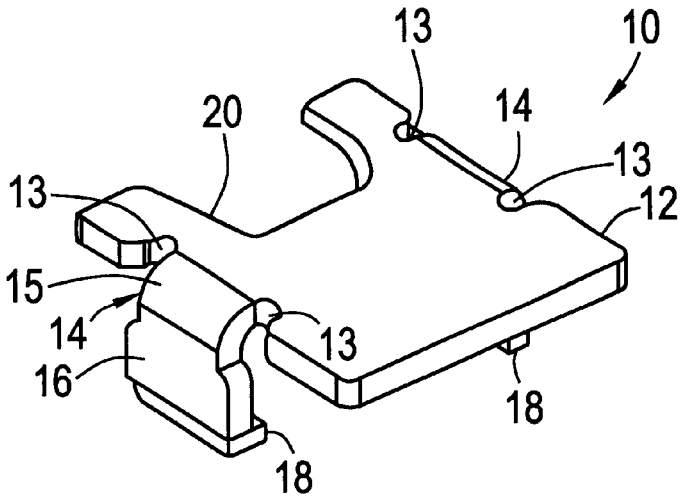
FIG. 1 is an isometric view of an arc runner having legs, retaining clips, and an opening for accommodating a contact, of the present invention.
Figure 2:
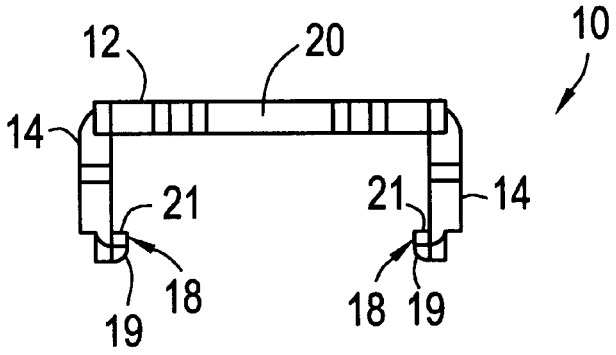
FIG. 2 is a front view of the arc runner shown in FIG. 1.
Figure 3:
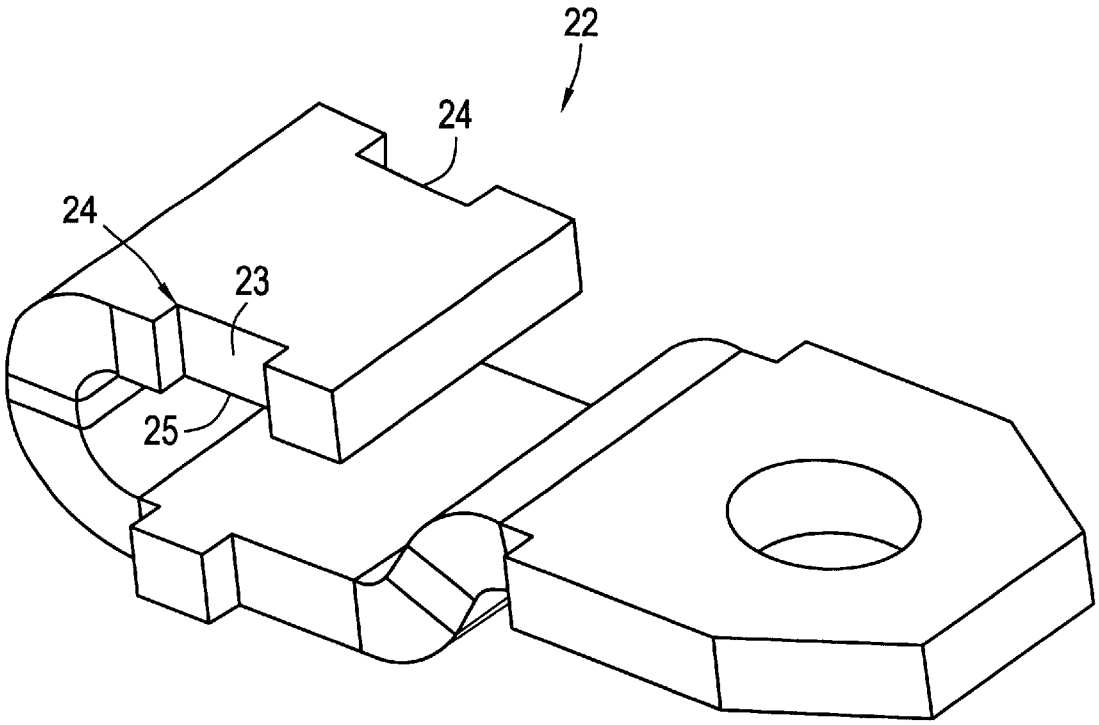
FIG. 3 is an isometric view of a load (or line) strap configured to receive the arc runner shown in FIGS. 1 and 2.

Referring to FIGS. 1 and 2, an arc runner of an exemplary embodiment of the present invention is generally shown at 10. Arc runner 10 is comprised of a main body portion defined by a planar member 12 and a retaining portion defined by legs 14 extending substantially perpendicularly from planar member 12. Planar member 12 is configured and dimensioned to conform to the shape of a surface of a load (or line) strap 22 (FIG. 3). Planar member 12 provides a pathway for an arc to follow and be diverted into an arc chute (not shown) to be dissipated in the event that an overcurrent or short circuit causes a circuit breaker to trip, i.e., to blow open.

Legs 14 are positioned on planar member 12 in such a manner so as to form a generally inverted U-shape. This U-shape allows planar member 12 to rest on a top surface of strap 22 while legs 14 extend down on opposing sides of strap 22. Legs 14 may be flexibly connected to planar member 12 enabling legs 14 to pinch the sides of strap 22 thus allowing planar member 12 to remain secured to strap 22. Portions along the edges of planar member 12 adjacent legs 14 may be removed to form cutouts 13. Cutouts 13 are dimensioned to increase the flexibility of legs 14 as legs 14 are mounted on load strap 22. Legs 14 may also be dimensioned to have thinner portions 15 and wider portions 16. Thinner portions 15 of legs 14 are positioned at the points at which legs 14 are attached to planar member 12 in order to further increase flexibility. Alternately, legs 14 may depend from strap 22 to secure planar member 12 to strap 22.

Retaining tabs 18 are disposed on the ends of legs 14 and are configured to extend toward each other. Retaining tabs 18 have a tapered or curved surface 19 positioned to facilitate the outwardly urging of legs 14 as arc runner 10 is being mounted on said strap 22. Positioned adjacent to said tapered or curved surface 19 is a flat surface 21 for engaging an underside surface of strap 22 thus clipping legs 14 to side surfaces of strap 22. When legs 14 are clipped to the side surfaces of strap 22, arc runner 10 is secured to strap 22.

Planar member 12 has a portion removed from it to form opening 20. Opening 20 is dimensioned, configured, and positioned on planar member 12 to accommodate a contact 26 when arc runner 10 is positioned on strap 22. Contact 26 is illustrated and discussed below with reference to FIG. 4. Opening 20 functions to mate with contact 26 thereby preventing arc runner 10 from rotating about a longitudinal axis of strap 22.

Retaining tabs 18 can be clearly seen (FIG. 2) depending from the ends of legs 14. When arc runner 10 is installed on strap 22, legs 14 extend along and engage opposing side surfaces 23 (FIG. 3) with notches 24 of strap 22. Retaining tabs 18 then engage an underside surface 25 (FIG. 3) of strap 22 and secure arc runner 10 into position on strap 22.

Referring now to FIG. 3, strap 22 is generally shown. Notches 24 are cut into opposing sides of strap 22 and are of dimensions sufficient to accommodate legs 14 when arc runner 10 is positioned on strap 22. Notches 24 prevent arc runner 10 from axial movement along strap 22 in the event that legs 14 do not tightly secure arc runner 10 to strap 22. Furthermore, notches 24 are formed on strap 22 in such a way that when arc runner 10 is positioned onto strap 22, opening 20 accommodates contact 26 of a circuit breaker (not shown).

Figure 4:
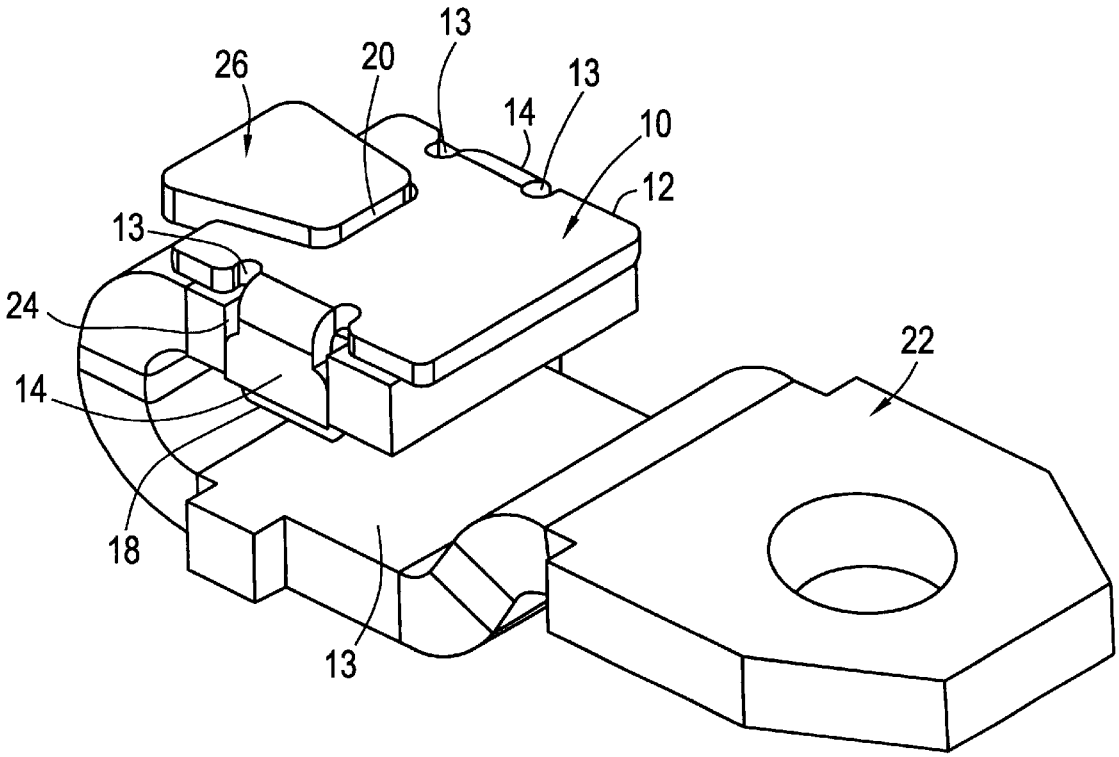
FIG. 4 is an isometric view of the arc runner of FIGS. 1 and 2 situated on the strap of FIG. 3 and accommodating a contact.

Referring to FIG. 4, arc runner 10 is shown on strap 22. Legs 14 are received in notches 24. Retaining tabs 18 hold legs 14 in place within notches 24 and secure arc runner 10 to strap 22. Contact 26 is accommodated by opening 20.

Figure 5:
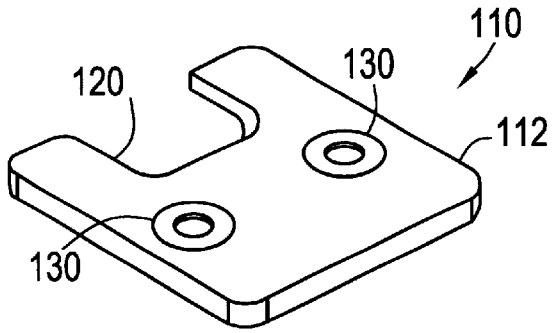
FIG. 5 is an isometric view of an alternate embodiment of an arc runner having a hole to accept a retaining pin and also having an opening for accommodating a contact, of the present invention.
Figure 6:
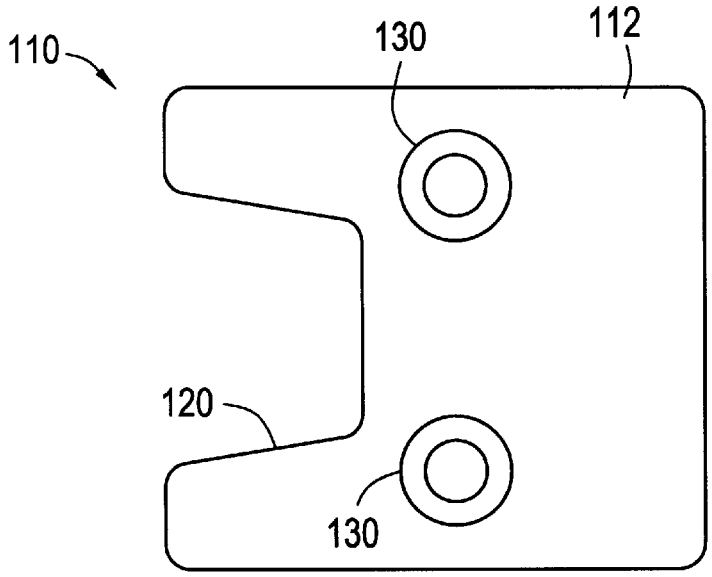
FIG. 6 is a plan view of the alternate embodiment of the arc runner, of the present invention.
Figure 7:
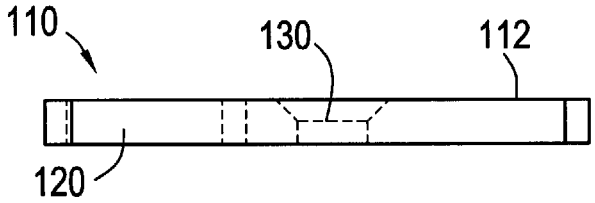
FIG. 7 is a side view of the alternate embodiment of the arc runner showing the detail of a chamfered hole, of the present invention.

Referring to FIGS. 5–7, in an alternative embodiment of the invention an arc runner 110 is formed as a generally planar member 112. At least one hole 130 extends through planar member 112. FIGS. 5–7 show planar member 112 having two holes extending therethrough; however, it should be understood that planar member 112 may contain only a single hole. The edges of hole 130 are chamfered so that a corresponding number of pins inserted from the side of planar member 112 having the smaller opening can be countersunk in hole 130. Planar member 112 has a portion removed from it to form an opening 120. Opening 120 is dimensioned, configured, and positioned on planar member 112 to accommodate a contact 126 (FIG. 9) when arc runner 110 is positioned on a load (or line) strap 122 (FIG. 8).

Figure 8:
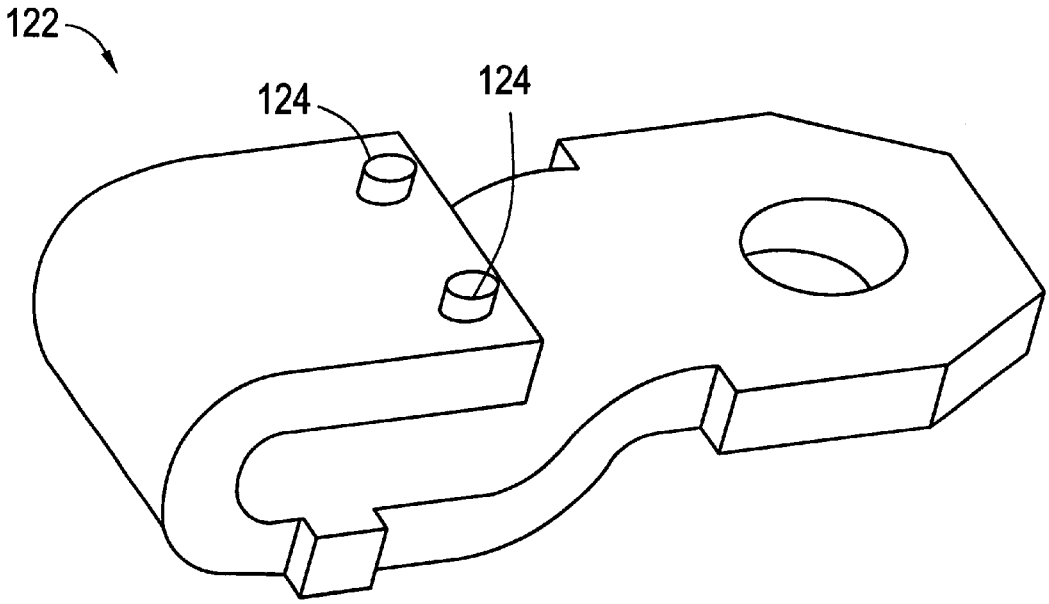
FIG. 8 is an alternate embodiment of a strap having the retaining pin and being configured to accept the alternate embodiment of the arc runner, of the present invention.

Referring now to FIG. 8, strap 122 has at least one protrusion of material created therefrom which is formed into at least one retaining pin 124. FIG. 8 shows strap 122 having two protrusions extending therefrom; however, it should be understood that strap 122 may contain only a single protrusion. Retaining pin 124 projects from the surface of strap 122 to mate with hole 130 of arc runner 110. Alternately, retaining pin 124 may project from planar member 112 to mate with hole 130 in strap 122. The protrusion of retaining pin 124 into hole 130 prevents axial movement of planar member 112 on strap 122.

Figure 9:
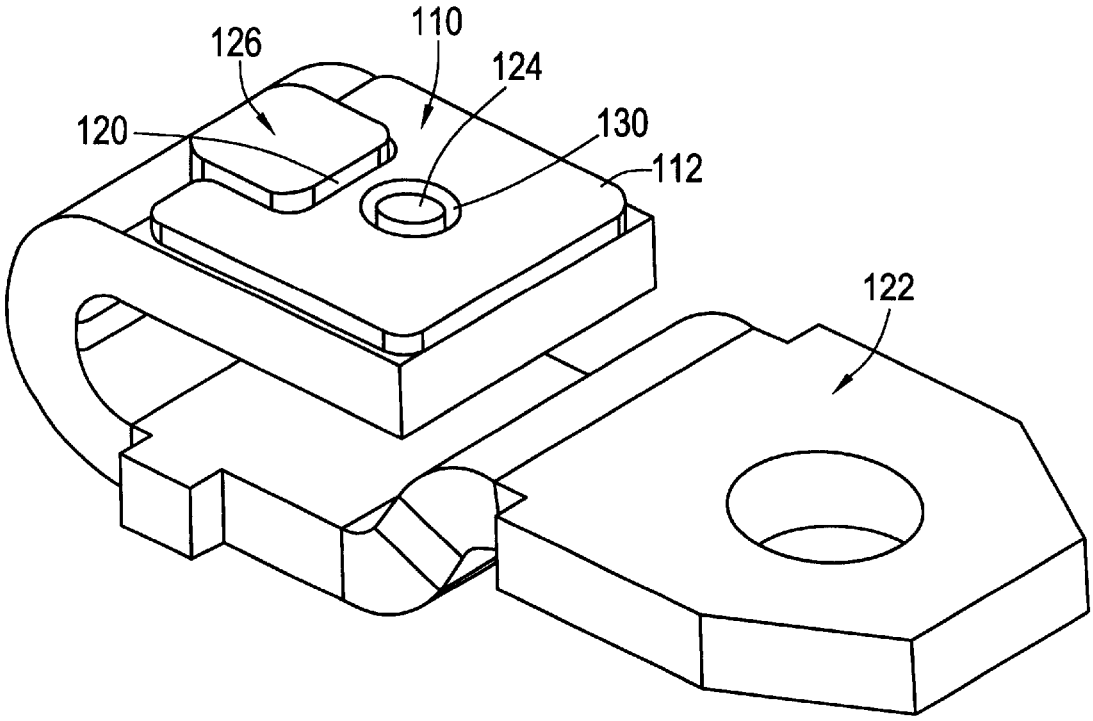
FIG. 9 is an isometric view of the strap having the retaining pin and also having the alternate embodiment of the arc runner positioned on it and accommodating the contact, of the present invention.

Referring now to FIG. 9, arc runner 110 is shown positioned on strap 122. Retaining pin 124 protrudes through hole 130 of planar member 112. The protrusion of retaining pin 124 into hole 130 is deformed to provide a countersunk means of securing arc runner 110 to strap 122. Deforming and countersinking the end of retaining pin 124 prevents separation of planar member 112 from strap 122. Planar member 112 is positioned on strap 122 in such a way that opening 120 accommodates contact 126. The combination of the protrusion of retaining pin 124 through hole 130 with the positioning of contact 126 in opening 120 secures arc runner 110 to strap 122.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly comprising:

a strap having an underside surface;

an arc runner mounted on said strap and including a planar member having opposing edges; and a pair of resilient legs depending outward from said opposing edges of said planar member, said resilient legs each having a retaining tab disposed on said legs and extending inwardly toward each other, said retaining tabs each having a tapered or curved surface to outwardly urge said legs during mounting of said arc runner on said strap and a flat surface adjacent to said tapered or curved surface positioned to engage said underside surface of said strap and retain said arc runner on said strap;

wherein said opposing edges of said planar member having cutout portions positioned adjacent to opposing sides of each of said legs at points where said legs depend from said arc runner, wherein said cutout portions allow said legs to be flexed outwardly and away from each other.

2. The assembly of claim 1 wherein said legs are dimensioned to be thinner at said points where said legs are attached to said arc runner and wider at points distal from said points where said legs are attached to said arc runner.

3. The assembly of claim 2 wherein said strap is notched on opposing edges to accommodate said legs depending from said arc runner.

4. The assembly of claim 2 wherein said arc runner is notched on one edge to accommodate a contact.

5. An arc runner assembly comprising:

a strap;

an arc runner disposed at said strap, said arc runner being capable of directing an arc; and a pin depending from one of said strap and said arc runner, said pin being received by a hole in one of said strap and said arc runner to retain said arc runner on said strap.

6. The arc runner assembly of claim 5 wherein a plurality of pins depend from one of said strap and said arc runner, said plurality of pins being received by a corresponding plurality of holes in one of said strap and said arc runner to retain said arc runner on said strap.

7. The arc runner assembly of claim 5 wherein said hole in one of said strap and said arc nine is countersunk.

8. The arc runner assembly of claim 5 wherein said pin is capable of being deformed once said pin engages said hole thus securing said arc runner to said strap.

9. The arc runner assembly of claim 8 wherein an edge of said arc runner is notched on one edge to accommodate a contact.

* * * * *